US009626902B2

(12) United States Patent
Kwon et al.

(10) Patent No.: US 9,626,902 B2
(45) Date of Patent: Apr. 18, 2017

(54) LIGHT EMISSION DRIVER FOR DISPLAY DEVICE, DISPLAY DEVICE AND DRIVING METHOD THEREOF

(71) Applicant: Samsung Display Co., Ltd., Yongin, Gyeonggi-do (KR)

(72) Inventors: Tae-Hoon Kwon, Yongin (KR); Ji-Hyun Ka, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 396 days.

(21) Appl. No.: 13/903,831

(22) Filed: May 28, 2013

(65) Prior Publication Data

US 2014/0111503 A1 Apr. 24, 2014

(30) Foreign Application Priority Data

Oct. 18, 2012 (KR) ..... 10-2012-0116034

(51) Int. Cl.
*G09G 3/36* (2006.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2320/0223* (2013.01); *G09G 2320/0233* (2013.01)

(58) Field of Classification Search
USPC ..... 345/98
See application file for complete search history.

(56) References Cited

U.S. PATENT DOCUMENTS

| | | | | |
|---|---|---|---|---|
| 8,810,139 | B2 * | 8/2014 | Kim et al. | 315/169.3 |
| 2004/0164978 | A1 * | 8/2004 | Shin et al. | 345/211 |
| 2005/0285827 | A1 * | 12/2005 | Eom | G09G 3/3233 345/76 |
| 2007/0089000 | A1 * | 4/2007 | Shin | 714/726 |
| 2008/0211745 | A1 * | 9/2008 | Lee et al. | 345/76 |
| 2010/0013824 | A1 * | 1/2010 | Kim et al. | 345/214 |
| 2010/0207968 | A1 * | 8/2010 | Kim | 345/691 |
| 2011/0193892 | A1 * | 8/2011 | Eom | 345/690 |
| 2011/0227904 | A1 * | 9/2011 | Choi | 345/212 |
| 2012/0188290 | A1 * | 7/2012 | Park | G09G 3/3266 345/690 |

FOREIGN PATENT DOCUMENTS

| | | | |
|---|---|---|---|
| KR | 10-2008-0033630 | A | 4/2008 |
| KR | 10-2008-0062458 | A | 7/2008 |
| KR | 10-2010-0009219 | A | 1/2010 |

* cited by examiner

*Primary Examiner* — Long D Pham
(74) *Attorney, Agent, or Firm* — Knobbe Martens Olson & Bear LLP

(57) ABSTRACT

A light emission driver for a display device is disclosed. In one aspect, the driver includes a first node to which first and second light emitting power source voltages are applied according to respective clock signals. The driver also includes a second node to which the first and third light emitting power source voltages are applied according to the respective clock signals. The driver further includes first and second transistors respectively turned on by the first and second nodes and respectively transmitting the second and first light emitting power source voltages to a light emitting signal output terminal, respectively.

11 Claims, 6 Drawing Sheets

LIGHT EMISSION DRIVER FOR DISPLAY DEVICE, DISPLAY DEVICE AND DRIVING METHOD THEREOF

CROSS-REFERENCE TO RELATED APPLICATION

This application claims priority to and the benefit of Korean Patent Application No. 10-2012-0116034 filed in the Korean Intellectual Property Office on Oct. 18, 2012, the entire contents of which are incorporated herein by reference.

BACKGROUND (a) Field

The described technology generally relates to a light emission driver, a display device, and driving methods of the light emission driver and the display device.

(b) Description of the Related Technology

An organic light emitting diode (OLED) display uses an OLED of which luminance is controlled by a current or a voltage. An OLED generally includes a positive electrode layer and a negative electrode layer forming an electric field and an organic light emitting material emitting light by the electric field.

Generally, OLED displays are classified into a passive matrix OLED (PMOLED) and an active matrix OLED (AMOLED) according to how they are driven.

Among them, the AMOLED emitting light selected for each unit pixel from the viewpoint of resolution, a contrast, and operation speed has become the most commonly used.

The AMOLED generates light by flowing a current to a light emitting element, that is, the organic light emitting diode to thereby display an image. In this case, a driving transistor of each pixel flows a constant current according to a grayscale of image data.

In recent years, panels are becoming larger, and large-size panels have the problem of picture quality degradation caused by a voltage drop IR-drop across wires for supplying electrical power and data signals to pixels. A voltage lower than the actual applied voltage is supplied to the pixels due to the voltage drop across the wires, and this affects the amount of current flowing through the driving TFT, thereby causing luminance deterioration of the display device.

SUMMARY

One inventive aspect is a light emission driver for a display device that can reduce influence of a voltage drop due to a power wiring, a display device, and driving methods of the light emission driver and the display device.

Another aspect is a light emission driver for a display device that can solve deterioration of image quality of the display device due to voltage drop of power wiring, a display device, and a method for driving the display device and the light emission driver.

Another aspect is a light emission driver for a display device which includes a plurality of light emitting driving blocks, and each of the light emitting driving blocks includes: a first node to which a second light emitting power source voltage is applied according to a clock signal input to a first clock signal input terminal and a first light emitting power source voltage is applied according to a clock signal input to a second clock signal input terminal; a second node to which the first light emitting power source voltage is applied according to the clock signal input to the first clock signal input terminal and a third light emitting power source voltage is applied according to the clock signal input to the second clock signal input terminal, and connected to a reverse light emitting signal output terminal to which a reverse light emitting signal is output; a first transistor turned on by the first node and transmitting the second light emitting power source voltage to a light emitting signal output terminal to which a light emitting signal is output; and a second transistor turned on by a voltage of the second node and transmitting the first light emitting power source voltage to the light emitting signal output terminal.

The second node may be connected with a relay signal output terminal outputting a relay signal applied to a sequential input terminal of the next light emitting driving block among the plurality of light emitting driving blocks.

The light emission driver for the display device may further include a third transistor including a gate electrode connected to the first node, a first electrode connected to the first light emitting power source voltage, and a second electrode connected to the second node.

The light emission driver for the display device may further include: a third node to which a clock signal input to the second clock signal input terminal is applied according to a relay signal applied to a sequentially input terminal from the previously arranged light emitting driving block among the plurality of light emitting driving blocks and a clock signal input to the first clock signal input terminal; and a fourth transistor including a gate electrode connected to the third node, a first electrode connected to the third light emitting power source voltage, and a second electrode connected to the second node.

The light emission driver for the display device may further include a fifth transistor including a gate electrode connected to the first clock signal input terminal, a first electrode connected to the second light emitting power source voltage, and a second electrode connected to the first node.

The light emission driver for the display device may further include: a sixth transistor including a gate electrode connected to the third node and a first electrode connected to the first light emitting power source voltage; and a seventh transistor including a gate electrode connected to the third node, a first electrode connected to a second electrode of the sixth transistor, and a second electrode connected to the first node.

The light emission driver for the display device may further include: a fourth node to which a relay signal input to the sequential input terminal according to a clock signal input to the first clock signal input terminal is transmitted; and a ninth transistor including a gate electrode connected to the fourth node, a first electrode connected to the second clock signal input terminal, and a second electrode connected to the third node.

The light emission driver for the display device may further include a tenth transistor including a gate electrode connected to the first clock signal input terminal, a first electrode connected to the first light emitting power source voltage, and a second electrode connected to a second electrode of the third node.

The light emission driver for the display device may further include an eleventh transistor including a gate electrode connected to the first clock signal input terminal, a first electrode connected to the sequential input terminal, and a second electrode connected to the fourth node.

The plurality of light emitting driving blocks may simultaneously output the first light emitting power source voltage to the light emitting signal output terminal according to an entire reset signal input to an entire reset signal input terminal, and simultaneously output the third light emitting power source voltage to the reverse light emitting signal output terminal and the relay signal output terminal.

The light emission driver for the display device may further include an eighth transistor including a gate electrode connected to the entire reset signal input terminal, a first electrode connected to the second light emitting power source voltage, and a second electrode connected to the third node.

The light emission driver for the display device may further include a twelfth transistor including a gate electrode connected to the entire reset signal input terminal, a first electrode connected to the first light emitting power source voltage, and a second electrode connected to the fourth node.

The light emission driver for the display device may further include a thirteenth transistor including a gate electrode connected to the entire reset signal input terminal, a first electrode connected to the first light emitting power source voltage, and a second electrode connected to the light emitting signal output terminal.

At least one of the first to thirteenth transistors may be an oxide thin film transistor.

Another aspect is a display device which includes: a plurality of pixels, each including a driving transistor controlling a driving current flowing to an organic light emitting diode (OLED) and a storage capacitor including a first electrode connected to a gate electrode of the driving transistor; and a light emission driver applying a reference voltage to a second electrode of the storage capacitor by outputting a reverse light emitting signal of a gate-on voltage for a period during which a data voltage is applied to each of the plurality of pixels, and applying a first power source voltage to the second electrode of the storage capacitor by outputting a light emitting signal of the gate-on voltage for a voltage during which the organic light emitting diode emits light by the driving current.

The driving transistor may include a first electrode connected to a first node, a second electrode connected to a second node, and a gate electrode connected to a third node. The first node may be applied with a first power source voltage according to the light emitting signal, the second node may be connected to the organic light emitting diode according to the light emitting signal, and the third node may be connected to the first electrode of the storage capacitor.

Each of the plurality of pixels may further include a switching transistor turned on by a scan signal of the gate-on voltage and transmitting a data voltage to the first node and a compensation transistor turned on by the scan signal of the gate-on voltage and diode-connecting the driving transistor.

Each of the plurality of pixels may further include an initialization transistor being turned on by a scan signal applied before the scan signal of the gate-on voltage is applied and transmitting an initialization voltage to the third node.

Each of the plurality of pixels may further includes: a first light emitting transistor including a gate electrode to which the light emitting signal is applied, a first electrode connected with the first power source voltage, and a second electrode connected to the first node; and a second light emitting transistor including a gate electrode to which the light emitting signal is applied, a first electrode connected to the second node, and a second electrode connected to an anode of the organic light emitting diode.

Each of the plurality of pixels may further include: a first reference voltage transistor including a gate electrode to which the reverse light emitting signal is input, a first electrode connected with the reference voltage, and a second electrode connected to the second electrode of the storage capacitor; and a second reference voltage transistor including a gate electrode to which the light emitting signal is applied, a first electrode connected to the first power source voltage, and a second electrode connected to the second electrode of the storage capacitor.

At least one of the switching transistor, the driving transistor, the compensation transistor, the initialization transistor, the first light emitting transistor, the second light emitting transistor, the first reference voltage transistor, and the second reference voltage transistor may be an oxide thin film transistor.

The light emission driver may include a plurality of light emitting driving blocks, and each of the plurality of light emitting driving blocks may include: a first node to which a second light emitting power source voltage is applied according to a clock signal input to a first clock signal input terminal and a first light emitting power source voltage according to a clock signal input to a second clock signal input terminal; a second node to which the first light emitting power source voltage is applied according to the clock signal input to the first clock signal input terminal and a third light emitting power source voltage according to a clock signal input to the second clock signal input terminal, and connected with a reverse light emitting signal output terminal to which a reverse light emitting signal is output; a first transistor turned on by a voltage of the first node and transmitting the second light emitting power source voltage to a light emitting signal output terminal to which a light emitting signal is output; and a second transistor turned on by a voltage of the second node and transmitting the first light emitting power source voltage to the light emitting signal output terminal.

A relay signal output terminal outputting a relay signal that is applied to a sequential input terminal of the next light emitting driving block among the plurality of light emitting driving blocks may be connected to the second node.

Another aspect is a method for driving a display device including a plurality of pixels, each including a driving transistor controlling a driving current flowing to an organic light emitting diode, a storage capacitor including a first electrode connected to a gate electrode of the driving transistor, a first reference voltage transistor applying a reference voltage to a second electrode of the storage capacitor according to a reverse light emitting signal, and a second reference voltage transistor transmitting a first power source voltage to a second electrode of the storage capacitor according to a light emitting signal, the method including: an initialization step during which a first scan signal is applied to an initialization transistor connected with the driving transistor and thus an initialization voltage is transmitted to the gate electrode of the driving transistor; a threshold voltage compensation and data writing step during which a second scan signal is applied to a compensation transistor that is connected to a switching transistor connected to the first electrode of the driving transistor and the second electrode of the driving transistor to diode-connect the driving transistor and thus a data voltage to which a threshold voltage of the driving transistor is reflected is transmitted to the gate electrode of the driving transistor; and a light emission step during which the light emitting signal is applied to a first light emitting transistor connected between the first power source voltage and the first electrode of the driving transistor and a second light emitting transistor connected between the second electrode of the driving transistor and the organic light emitting diode to flow a driving current to the organic light emitting diode.

The initialization step may include: applying the reverse light emitting signal as a gate-on voltage to turn on the first reference voltage transistor and transmit the reference voltage to the second electrode of the storage capacitor; and applying the light emitting signal as a gate-off voltage to turn off the second reference voltage transistor.

The threshold voltage compensation and data writing step may include: applying the reverse light emitting signal as the gate-on voltage to turn on the first reference voltage transistor and transmit the reference voltage to the second electrode of the storage capacitor; and applying the light emitting signal as the gate-off voltage to turn off the second reference voltage transistor.

The light emission step may include: applying the reverse light emitting signal as the gate-off signal to turn off the first reference voltage transistor; and applying the light emitting signal as the gate-on voltage to turn on the second reference voltage transistor and transmit the first power source voltage to the second electrode of the storage capacitor.

DETAILED DESCRIPTION

Figure 1:
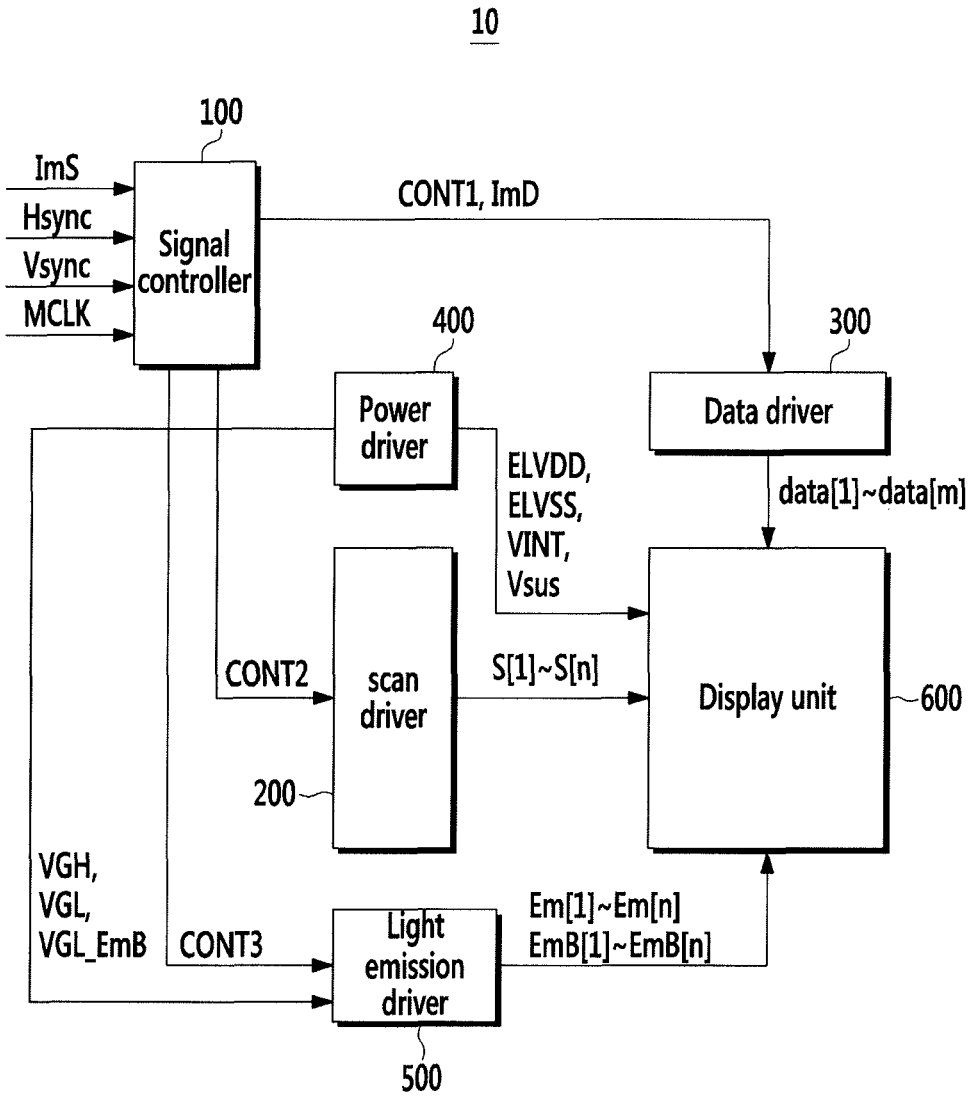
FIG. 1 is a block diagram of a display device according to an exemplary embodiment.

Embodiments will be described more fully hereinafter with reference to the accompanying drawings. As those skilled in the art would realize, the described embodiments may be modified in various different ways, all without departing from the spirit or scope of the present invention.

Further, in exemplary embodiments, since like reference numerals designate like elements having the same configuration, a first exemplary embodiment is representatively described, and in other exemplary embodiments, only a configuration different from the first exemplary embodiment will be described.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram of a display device according to an exemplary embodiment.

Referring to FIG. 1, a display device 10 includes a signal controller 100, a scan driver 200, a data driver 300, a power driver 400, a light emission driver 500, and a display unit 600.

The signal controller 100 receives a video signal ImS and a synchronization signal input from an external device. The video signal ImS includes luminance information of a plurality of pixels. Luminance has a predetermined number of grays, for example, 1024 ($=2^{10}$), 256 ($=2^{8}$), or 64 ($=2^{6}$). The synchronization signal includes a horizontal synchronization signal Hsync, a vertical synchronization signal Vsync, and a main clock signal MCLK.

The signal controller 100 generates first to third driving control signals CONT1, CONT2, and CONT3 and a video data signal ImD according to the video signal ImS, the horizontal synchronization signal Hsync, the vertical synchronization signal Vsync, and the main clock signal MCLK.

The signal controller 100 divides the video signal ImS per frame unit according to the vertical synchronization signal Vsync, and generates the video data signal ImD by dividing the video signal ImS per scan line unit according to the horizontal synchronization signal Hsync. The signal controller 100 transmits the video data signal ImD and the first driving control signal CONT1 to the data driver 300.

The display unit 600 is a display area including a plurality of pixels. In the display unit 600, a plurality of scan lines extended substantially in a row direction and substantially parallel with each other, a plurality of data lines extended substantially in a column direction and substantial parallel with each other, a plurality of light emission lines extended substantially in a row direction and substantial parallel with each other, and a plurality of reverse light emission lines extended substantially in a row direction and substantial parallel with each other are formed to be connected with the pixels.

The scan driver 200 is connected to the scan lines, and generates a plurality of scan signals S[1] to S[n] according to the second driving control signal CONT2. The scan driver 200 can sequentially apply the scan signals S[1] to S[n] of the gate-on voltage to the plurality of scan lines.

The data driver 300 is connected to the data lines, samples and holes the image data signal ImD input according to the first driving control signal CONT1, and transmits a plurality of data signals data[1] to data[m] to the data lines. The data driver 300 applies a data signal having a predetermined voltage range to the data lines corresponding to the scan signals S[1] to S[n] of the gate-on voltage to write data to the pixels.

The power driver 400 provides a first power source voltage ELVDD, a second power source voltage ELVSS, an initialization voltage VINT, and a reference voltage Vsus to the pixels included in the display unit 600

The first power source voltage ELVDD may be a high level voltage and the second power source voltage ELVSS may be a low level voltage. The initialization voltage VINT is a predetermined level voltage for initialization of the pixels. The reference voltage Vsus is a predetermined level voltage for maintaining a data voltage input to the pixels. The reference voltage Vsus may be substantially the same level of the first power source voltage ELVDD, and is provided to the pixels through wirings that is different from power wiring of the first power source voltage ELVDD.

In addition, the power driver 400 provides a first light emitting power source voltage VGH, a second light emitting power source voltage VGL, and the third light emitting power source voltage VGL_EMB to the light emission driver 500. The first light emitting power source voltage VGH may be a high level voltage, and the second light emitting power source voltage VGL and the third light emitting power source voltage VGL_EMB may be low level voltages. The first light emitting power source voltage VGH and the second light emitting power source voltage VGL are driving voltages for generating light emitting signals Em[1] to Em[n]. The third light emitting power source voltage VGL_EMB is a driving voltage for driving reverse light emitting signals light emitting signals EmB[1] to EmB[n].

The light emission driver 500 is connected to the light emitting lines and the reverse light emitting lines, and generates the light emitting signals Em[1] to Em[n] and the reverse light emitting signals EmB[1] to EmB[n] according to the third driving control signal CONT3. When data is written to the pixel, the light emission driver 500 sequentially applies the light emitting signals Em[1] to Em[n] of a gate-off voltage to the light emitting lines, and after the data is written, the light emission driver 500 sequentially applies the light emitting signals Em[1] to Em[n] of a gate-on voltage to the pixels for light emission. The light emission driver 500 applies the reverse light emitting signals EmB[1] to EmB[n] of a reverse level of the light emitting signals Em[1] to Em[n] to the reverse light emitting lines.

Figure 2:
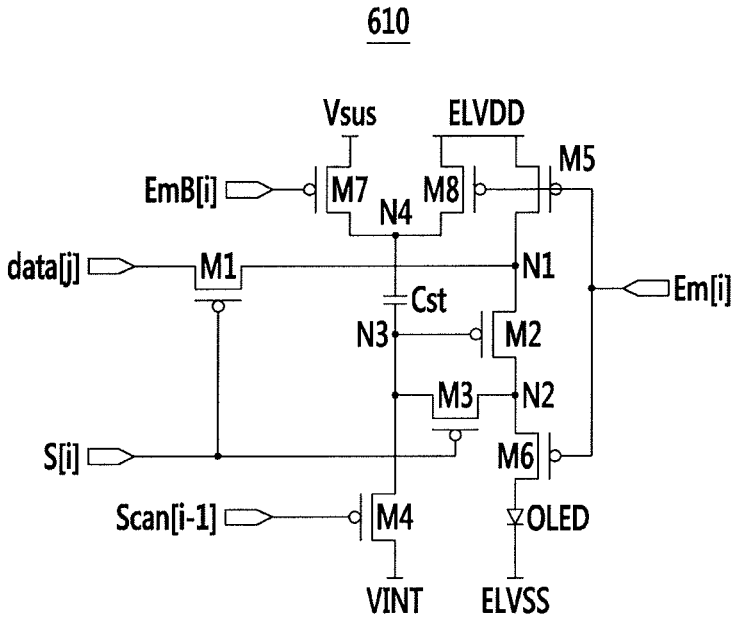
FIG. 2 is a circuit diagram of a pixel according to an exemplary embodiment.

FIG. 2 is a circuit diagram of the pixel according to an exemplary embodiment. The pixel of FIG. 2 is one of the pixels included in the display device 10 of FIG. 1.

Referring to FIG. 2, a pixel 610 includes a switching transistor M1, a driving transistor M2, a compensation transistor M3, an initialization transistor M4, a first light emitting transistor M5, a second light emitting transistor M6, a first reference voltage transistor M7, a second reference voltage transistor M8, a sustain capacitor Cst, and an organic light emitting diode (OLED).

The switching transistor M1 includes a gate electrode connected to the scan line, a first electrode connected to the data line, and a second electrode connected to a first node N1. The switching transistor M1 is turned on by a scan signal S[i] of the gate-on voltage applied to the scan line and thus transmits a data signal data[j] applied to the data line to the first node N1.

The driving transistor M2 includes a gate electrode connected to a third node N3, a first electrode connected to the first node N1, and a second electrode connected to a second node N2. The driving transistor M2 is turned on/off by a voltage of the third node N3 to control a driving current flowing to the OLED from the first power source voltage ELVDD.

The compensation transistor M3 includes a gate electrode connected to the scan line, a first electrode connected to the second node N2, and a second electrode connected to the third node N3. The compensation transistor M3 is turned on by the scan signal S[i] of the gate-on voltage applied to the scan line and thus diode-connects the driving transistor M2.

The initialization transistor M4 includes a gate electrode connected to a scan line arranged one row ahead of the scan line connected to the switching transistor M1, a first electrode connected to the initialization voltage VINT, and a second electrode connected to the third node N3. The initialization transistor M4 is turned on by a scan signal S[i−1] of the gate-on voltage applied to the previously arranged scan line and thus transmits the initialization voltage to the third node N3.

The first light emitting transistor M5 includes a gate electrode connected to the light emitting line, a first electrode connected to the first power source voltage ELVDD, and a second electrode connected to the first node N1. The first light emitting transistor M5 is turned on by the light emitting signal Em[i] of the gate-on voltage and thus transmits the first power source voltage ELVDD to the first node N1.

The second light emitting transistor M6 includes a gate electrode connected to the light emitting line, a first electrode connected to the second node N2, and a second electrode connected to an anode of the organic light emitting diode OLED. The second light emitting transistor M6 is turned on by the light emitting signal Em[i] of the gate-on voltage and thus connects the second node N2 and the anode of the organic light emitting diode OLED.

The first reference voltage transistor M7 includes a gate electrode connected to the reverse light emitting line, a first electrode connected to the reference voltage Vsus, and a second electrode connected to a fourth node N4. The first reference voltage transistor M7 is turned on by a reverse light emitting signal EmB[i] of the gate-on voltage applied to the reverse light emitting lines and thus transmits the reference voltage Vsus to the fourth node N4.

The second reference voltage transistor M8 includes a gate electrode connected to the light emitting line, a first electrode connected to the first power source voltage ELVDD, and a second electrode connected to the fourth node N4. The second reference voltage transistor M8 is turned on by the light emitting signal Em[i] of the gate-on voltage applied to the light emitting line and thus transmits the first power source voltage ELVDD to the fourth node N4.

The sustain capacitor Cst includes a first electrode connected to the third node N3 and a second electrode connected to the fourth node N4. The sustain capacitor Cst stores a data signal data[j] applied to the third node N3.

The OLED includes the anode connected to the second node N2 and a cathode connected to the second power source voltage ELVSS. The OLED can emit light of one of primary colors. Examples of the primary colors may include three primary colors of red R, green G, and blue B, and a desired color may be displayed by a spatial sum or a temporal sum of the three primary colors.

The switching transistor. M1, the driving transistor M2, the compensation transistor M3, the initialization transistor M4, the first light emitting transistor M5, the second light emitting transistor M6, the first reference voltage transistor M7, and the second reference voltage transistor M8 may be p-channel field effect transistors. In this case, the gate-on voltage turning on the switching transistor M1, driving transistor M2, the compensation transistor M3, the initialization transistor M4, the first light emitting transistor M5, the second light emitting transistor M6, the first reference voltage transistor M7, and the second reference voltage transistor M8 is a low level voltage and the gate-off voltage turning off the transistors is a high level voltage.

The transistors are described as the p-channel field effect transistors, but at least one of the switching transistor M1, the driving transistor M2, the compensation transistor M3, the initialization transistor M4, the first light emitting transistor M5, the second light emitting transistor M6, the first reference voltage transistor M7, and the second reference voltage transistor M8 may be an n-channel field effect transistor. In this case, the gate-on voltage turning on the n-channel field effect transistor is a high level voltage and the gate-off voltage turning off the transistor is a low level voltage.

The switching transistor M1, the driving transistor M2, the compensation transistor M3, the initialization transistor M4, the first light emitting transistor M5, the second light emitting transistor M6, the first reference voltage transistor M7, and the second reference voltage transistor M8 may be provided as one of amorphous silicon thin film transistor (amorphous-Si TFT), a low temperature poly-silicon (LTPS) thin film transistor, and an oxide thin film transistor (oxide TFT). The oxide TFT may have an activation layer of an oxide such as amorphous indium-galium-zinc-oxide (IGZO), zinc-oxide (ZnO), titanium oxide (TiO), and the like.

Hereinafter, a driving method of the display device 10 will be described with reference to FIG. 1 to FIG. 3.

Figure 3:
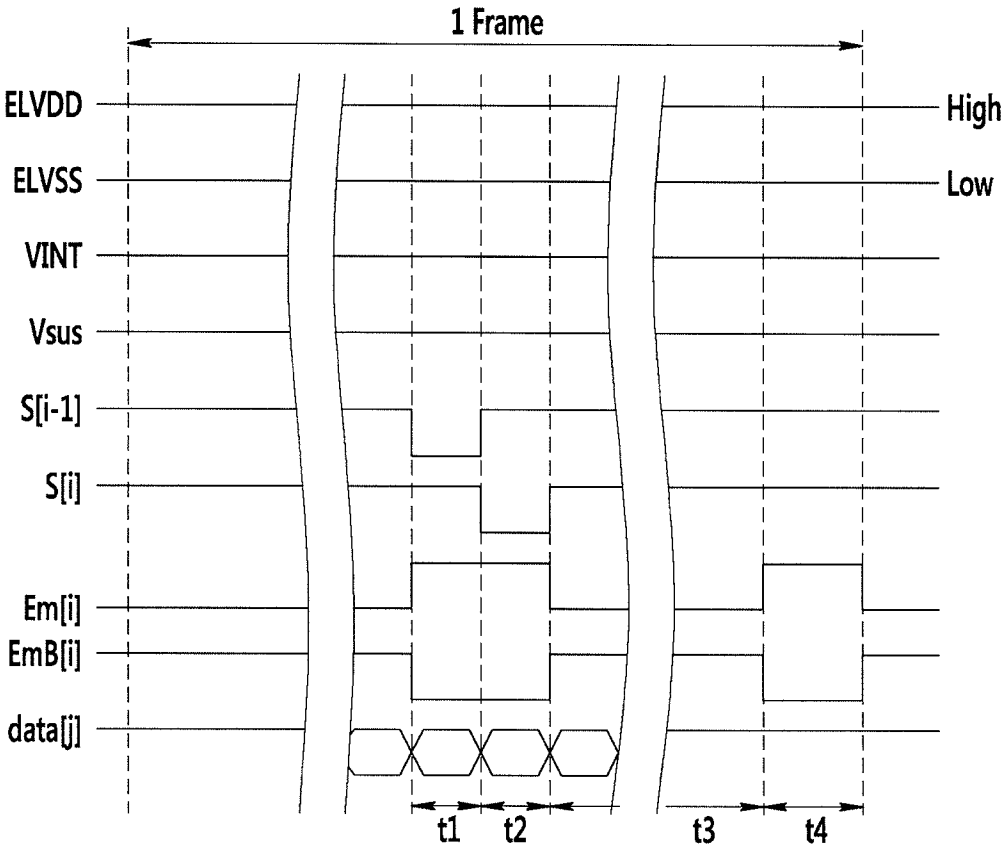
FIG. 3 is a timing diagram of the display device according to an exemplary embodiment.

FIG. 3 is a timing diagram of a driving method of the display device according to an exemplary embodiment.

Referring to FIG. 1 to FIG. 3, the first power source voltage ELVDD is applied as a high level voltage and the second power source voltage ELVSS is applied as a low level voltage. The initialization voltage VINT and the reference voltage Vsus are applied with predetermined level.

The scan signals S[1] to S[n] of the gate-on voltage are sequentially applied to the scan lines. During a time t1, a scan signal S[i−1] applied to the (i−1)-th scan line is applied as a low level voltage. During a time t2, a scan signal S[i] applied to the i-th scan line is applied as a low level voltage.

The light emitting signals Em[1] to Em[n] of the gate-off voltage are sequentially applied to the light emitting lines corresponding to the sequentially applied scan signals S[1] to S[n] of the gate-on signal. A light emitting signal Em[i] applied to the i-th light emitting line is applied as a high level voltage during t1 to t2. A reverse light emitting signal EmB[i] applied to the i-th reverse light emitting line is applied as a low level voltage during t1 to t2.

During the time t1, the initialization transistor M4 and the first reference voltage transistor M7 are turned on. As the initialization transistor M4 is turned on, the initialization voltage VINT is transmitted to the third node N3. As the first reference voltage transistor M7 is turned on, the reference voltage Vsus is transmitted to the fourth node N4. Accordingly, both-end voltages of the sustain capacitor Cst are initialized to the reference voltage Vsus and the initialization voltage VINT.

That is, the time t1 is a period during which the gate voltage of the driving transistor M2 is initialized to the initialization voltage VINT.

During the time t2, the switching transistor M1, the compensation transistor M3, and the first reference voltage transistor M7 are turned on. In this case, the data signal data[j] is applied with a data voltage Vdat having a predetermined voltage range. As the switching transistor M1 is turned on, the data signal data[j] is transmitted to the first node N1. As the compensation transistor M3 is turned on, the driving transistor M2 is diode-connected, and a data voltage (Vdat-Vth) to which a threshold voltage Vth of the driving transistor M2 is reflected is transmitted to the third node N3. As the first reference voltage transistor M7 is turned on, the reference voltage Vsus is applied to the fourth node N4. A (Vsus-(Vdat-Vth)) voltage is stored in the sustain capacitor Cst.

That is, the time t2 is a threshold voltage compensation and data writing period during which the data voltage (Vdat-Vth) is applied to the gate electrode of the driving transistor M2.

During a time to after the threshold voltage compensation and data writing period, the light emitting signal Em[i] applied to the i-th light emitting line is applied as the low level voltage and the reverse light emitting signal EmB[i] applied to the i-th reverse light emitting line is applied as the high level voltage. As the light emitting signal Em[i] is applied as the low level voltage, the first light emitting transistor M5, the second light emitting transistor M6, and the second reference voltage transistor M8 are turned on. As the first light emitting transistor M5 is turned on, the first power source voltage ELVDD is applied to the first node N1. In this case, the gate electrode of the driving transistor M2 is in the state of being applied with the (Vdat-Vth) voltage, and a driving current ($loled=\beta/2\ (Vgs-Vth)^2=\beta/2\ \{ELVDD-(Vdat-Vth)-Vth\}^2=(ELVDD-Vdat)^2$) flows through the driving transistor M2. Here, Vgs denotes a gate-source voltage difference of the driving transistor M2 and β denotes a parameter determined by a characteristic of the driving transistor M2. The driving current flowing to the organic light emitting diode OLED is not influenced by a threshold voltage deviation of the driving transistor M2. Since the second light emitting transistor M6 is turned on, the organic light emitting diode OLED emits light by the driving current loled.

That is, the time t3 is a light emission period during which the OLED emits light according to the data voltage Vdat.

With the above-described method, the pixels sequentially emit light by performing the initialization period T1, the threshold voltage compensation and data writing period t2, and the light emission period to per scan line.

During a time t4, the light emitting signals Em[1] to Em[n] are simultaneously applied as the high level voltage and the reverse light emitting signals EmB[1] to EmB[n] are simultaneously applied as the low level voltage. When the light emitting signals Em[1] to Em[n] are simultaneously applied as the high level voltage in the state that the pixels entirely emit light during the light emission period to, the first light emitting transistor M5 and the second light emitting transistor M6 of each of the pixels are turned off. Accordingly, the driving current loled flowing to the organic light emitting diode OLED of each of the pixels is blocked and thus emission of the pixels are entirely stopped.

That is, a time t4 is an entire reset period for stopping emission of the entire pixels. The entire reset period t4 may be omitted according to a driving method of the display device 10.

If the first power source voltage ELVDD is always applied to the first electrode of the storage capacitor Cst, the voltage (Vdat-Vth) transmitted to the gate electrode of the driving transistor M2 during the threshold voltage compensation and data writing period t2 cannot be sufficiently stored in the storage capacitor Cst due to a voltage drop in the power wiring of the first power source voltage ELVDD. Thus, non-uniform driving current loled flows to the organic light emitting diode OLED during the light emission period t4, thereby causing luminance deviation.

As suggested, the reference voltage Vsus applied through a different wiring than the power wiring of the first power source voltage ELVDD is applied to the first electrode of the storage capacitor Cst during the threshold voltage compensation and data writing period t2 to sufficiently store the (Vdat-Vth) voltage in the storage capacitor Cst. Accordingly, uniform driving current loled can be flow to the organic light emitting diode OLED during the light emission period to, and luminance deviation in the display device 10 due to the voltage drop of the power wiring can be prevented.

Figure 4:
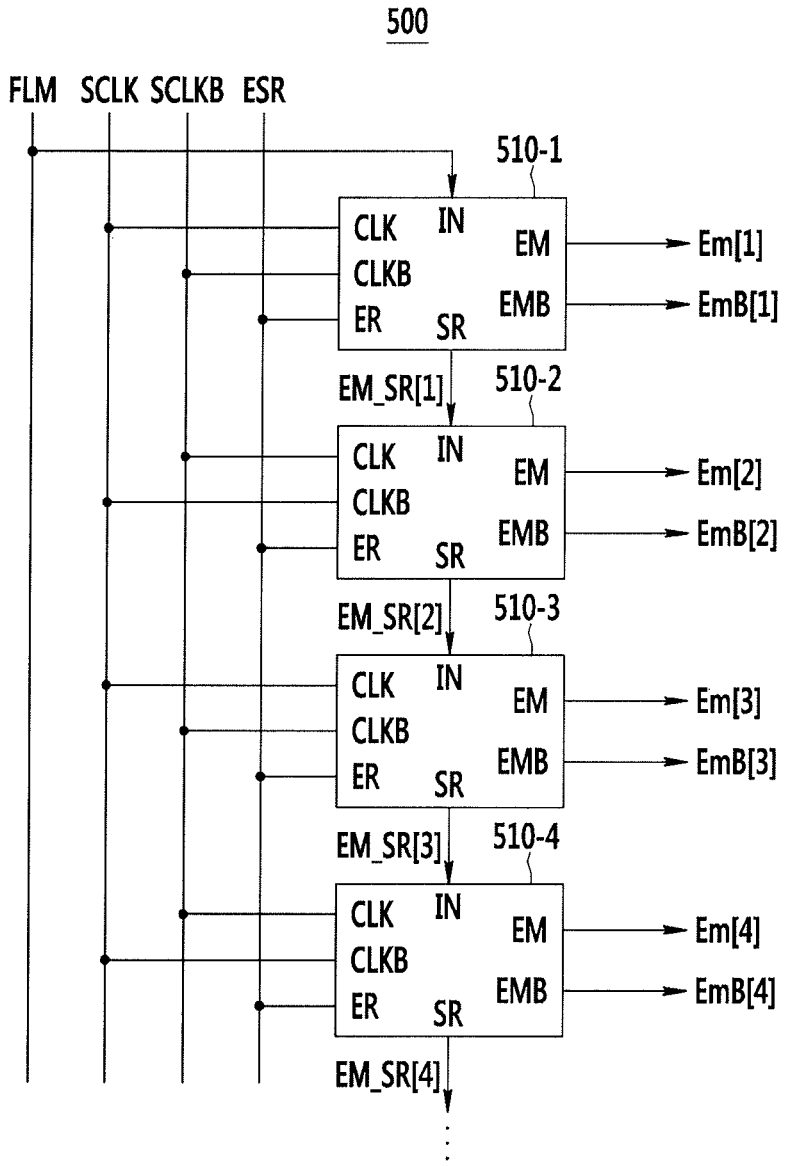
FIG. 4 is a block diagram of a light emission driver according to an exemplary embodiment.

FIG. 4 is a block diagram of the light emission driver according to an exemplary embodiment.

Referring to FIG. 4, the light emission driver 500 includes a plurality of light emitting driving blocks 510-1, 510-2, 510-3, 510-4, . . . generating the light emitting signals Em[1] to Em[n] and the reverse light emitting signals EmB[1] to EmB[n]. Each of the light emitting driving blocks 510-1, 510-2, 510-3, 510-4, . . . generates the light emitting signals Em[1] to Em[n] respectively transmitted to the light emitting lines and generates the reverse light emitting signals EmB[1] to EmB[n] respectively transmitted to the reverse light emitting lines by receiving an input signal.

The input signal of each of the light emitting driving blocks 510-1, 510-2, 510-3, 510-4, . . . includes a first clock signal SCLK1, a second clock signal SCLKB, an entire reset signal ESR, and a frame start signal FLM or a relay signal EM_SR of the neighboring light emitting driving block.

Each of the light emitting driving blocks 510-1, 510-2, 510-3, 510-4, . . . includes a first clock signal input terminal CLK, a second clock signal input terminal CLKB, an entire reset signal input terminal ER, a frame start signal FLM or a sequential input terminal IN to which the relay signal EM_SR is input, a light emitting signal output terminal EM, a reverse light emitting signal output terminal EMB, and a relay signal output terminal SR.

A first clock signal input terminal CLK of each of the odd numbered light emitting driving blocks 510-1, 510-3, . . . is connected to a wiring of the first clock signal SCLK and a second clock signal input terminal CLKB thereof is connected to a wiring of the second clock signal SCLKB. A first clock signal input terminal CLK of each of the even numbered light emitting driving blocks 510-2, 510-4, . . . is connected to a wiring of the second clock signal SCLKB and a second clock signal input terminal CLKB thereof is connected to a wiring of the first clock signal SCLK.

The frame start signal FLM is input to the sequential input terminal IN of the first light emitting driving block 510-1, and relay signals EM_SR[1], EM_SR[2], EM_SR[3], . . . of the previously arranged scan driving blocks are input to the sequential input terminals IN of other light emitting driving blocks 510-2, 510-3, 510-4, . . . .

Each of the light emitting driving blocks 510-1, 510-2, 510-3, 510-4, . . . outputs the light emitting signals Em[1], Em[2], Em[3], Em[4], . . . , the reverse light emitting signals EmB[1], EmB[2], EmB[3], EmB[4], . . . , and the relay signals EM_SR[1], EM_SR[2], EM_SR[3], EM_SR[4], . . . generated according to the signals input to the first clock signal input terminal CLK, the second clock signal input terminal CLKB, and the entire reset signal input terminal ER.

As the frame start signal FLM of the gate-on voltage is applied to the sequential input terminal IN, the first light emitting driving block 510-1 outputs the light emitting signal EM[1] to the first light emitting line and the reverse light emitting signal EmB[1] to the first reverse light emitting line, and transmits the relay signal EM_SR[1] to the second light emitting driving block 510-2. As the relay signal EM_SR[1] of the gate-on voltage is applied from the first light emitting driving block 510-1, the second light emitting driving block 510-2 outputs the light emitting signal EM[2] to the second light emitting line and the reverse light emitting line EmB[2] to the second reverse light emitting line, and transmits the relay signal EM_SR[2] to the third light emitting driving block 510-3. As described, the light emitting driving blocks 510-1, 510-2, 510-3, 510-4, . . . sequentially output the light emitting signals Em[1], Em[2] Em[3], Em[4], . . . , the reverse light emitting signals EmB[1], EmB[2], EmB[3], EmB[4], . . . , and the relay signals EM_SR[1], EM_SR[2], EM_SR[3], EM_SR [4], . . . .

Figure 5:
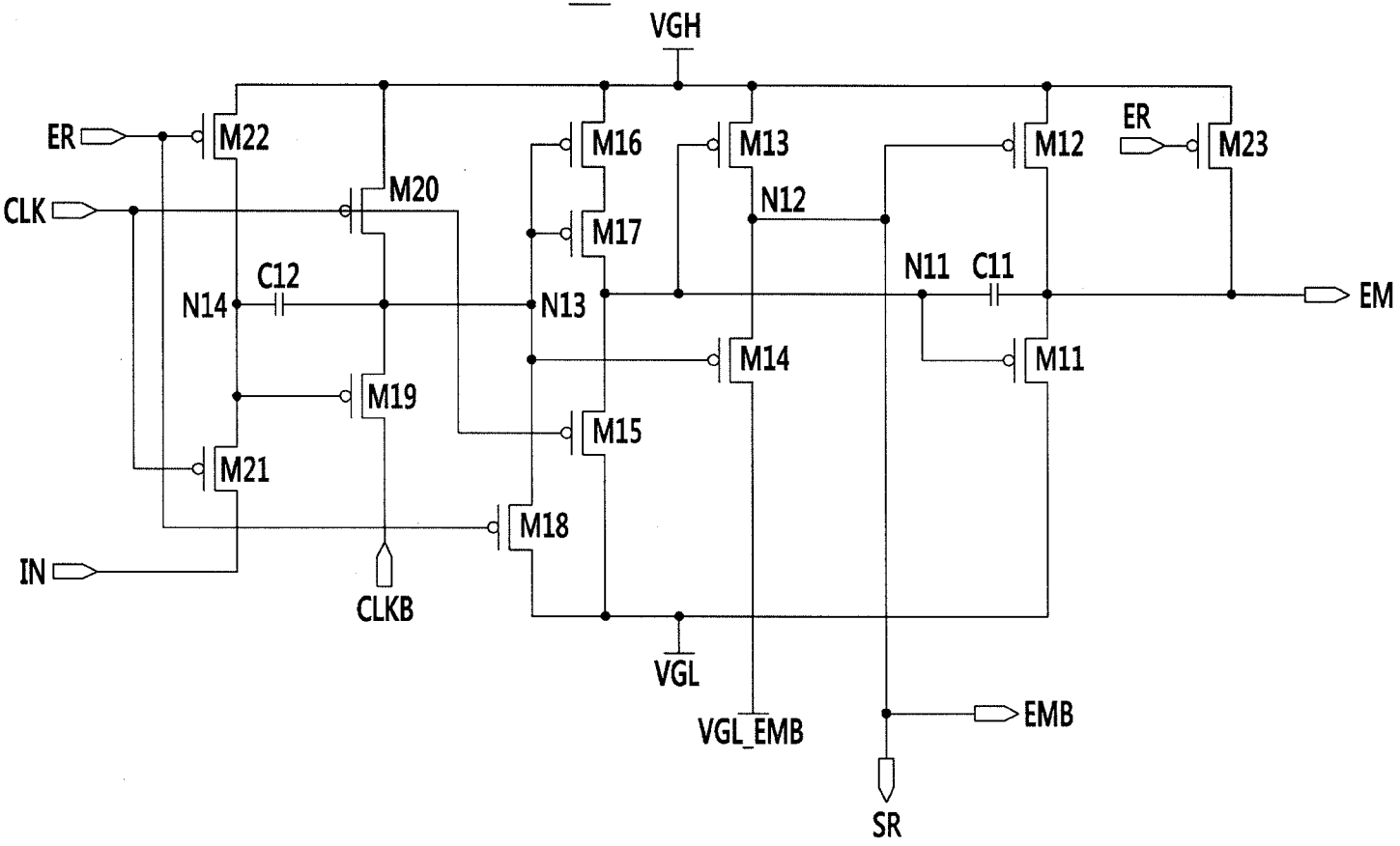
FIG. 5 is a circuit diagram of a light emission driving block included in the light emission driver according to an exemplary embodiment.

FIG. 5 is a circuit diagram of the light emitting driving block included in the light emission driver according to an exemplary embodiment.

Referring to FIG. 5, the light emitting driving block 510 includes a plurality of transistors M11 to M23 and a plurality of capacitors C11 and C12.

The first transistor M11 includes a gate electrode connected to a first node N11, a first electrode connected to the second light emitting power source voltage VGL, and a second electrode connected to the light emitting signal output terminal EM.

The second transistor M12 includes a gate electrode connected to a second node N12, a first electrode connected to the first light emitting power source voltage VGH, and a second electrode connected to the light emitting signal output terminal EM.

The third transistor M13 includes a gate electrode connected to the first node N11, a first electrode connected to the first light emitting power source voltage VGH, and a second electrode connected to the second node N12.

The fourth transistor M14 includes a gate electrode connected to a third node N13, a first electrode connected to the third light emitting power source voltage VGL_EMB, and a second electrode connected to the second node N12.

The fifth transistor M15 includes a gate electrode connected to the first clock signal input terminal CLK, a first electrode connected to the second light emitting power source voltage VGL, and a second electrode connected to the first node N11.

The sixth transistor M16 includes a gate electrode connected to the third node N13, a first electrode connected to the first light emitting power source voltage VGH, and a second electrode connected to a first electrode of the seventh transistor M17.

The seventh transistor M17 includes a gate electrode connected to the third node N13, the first connected to the second electrode of the sixth transistor M16, and a second electrode connected to the first node N11.

The eighth transistor M18 includes a gate electrode connected to the entire reset signal input terminal ER, a first electrode connected to the second light emitting power source voltage VGL, and a second electrode connected to the third node N13.

The ninth transistor M19 includes a gate electrode connected to the fourth node N14, a first electrode connected to the second clock signal input terminal CLKB, and a second electrode connected to the third node N13.

The tenth transistor M20 includes a gate electrode connected to the first clock signal input terminal CLK, a first electrode connected to the first light emitting power source voltage VGH, and a second electrode connected the third node N13.

The eleventh transistor M21 includes a gate electrode connected to the first clock signal input terminal CLK, a first electrode connected to the sequential input terminal IN, and a second electrode connected to fourth node N14.

The twelfth transistor M22 includes a gate electrode connected to the entire reset signal input terminal ER, a first electrode connected to the first light emitting power source voltage VGH, and a second electrode connected to the fourth node N14.

The thirteenth transistor M23 includes a gate electrode connected to the entire reset signal input terminal ER, a first electrode connected to the first light emitting power source voltage VGH, and a second electrode connected to the light emitting signal output terminal EM.

The first capacitor C11 includes a first electrode connected to the first node N11 and a second electrode connected to the light emitting signal output terminal EM.

The second capacitor C12 includes a first electrode connected to the fourth node N14 and a second electrode connected to the third node N13.

The reverse light emitting signal output terminal EMB and the relay signal output terminal SR are connected to the second node N12.

The transistors M11 to M23 may be provided as p-channel field effect transistors. In this case, a gate-on voltage turning on the transistors M11 to M23 is a low level voltage and a gate-off voltage turning off the transistors is a high level voltage.

Although the transistors M11 to M23 are provided as the p-channel field effect transistor, at least one of the transistors M11 to M23 may be provided as an n-channel field effect transistor. In this case, a gate-on voltage turning on the n-channel field effect transistor is a high level voltage and a gate-off voltage turning off the transistor is a low level voltage.

The transistors M11 to M23 may be provided as one of an amorphous-Si TFT, a LTPS thin film transistor, and an oxide TFT. The oxide TFT may have an activation layer of an oxide such as amorphous indium-galium-zinc-oxide (IGZO), zinc-oxide (ZnO), titanium oxide (TiO), and the like.

Hereinafter, a driving method of the light emission driver 500 will be described with reference to FIG. 4 to FIG. 6.

Figure 6:
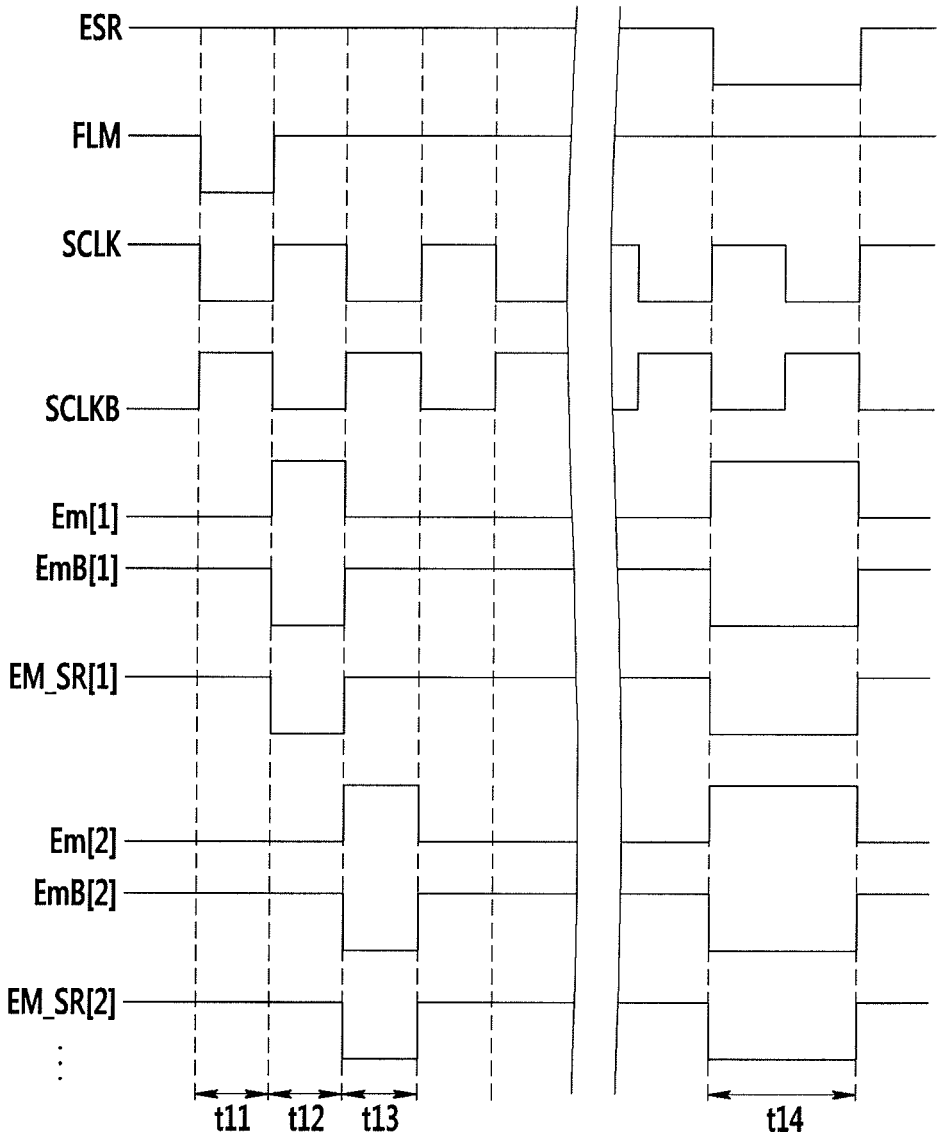
FIG. 6 is a timing diagram of a driving method of the light emission driver according to an exemplary embodiment.

FIG. 6 is a timing diagram of a driving method of the light emission driver according to an exemplary embodiment.

Referring to FIG. 4 to FIG. 6, application of the first clock signal SCLK and the second clock signal SCLKB of the gate-on voltage and the gate-off voltages are periodically repeated. In this case, the second clock signal SCLKB is a reverse signal of the first clock signal SCLK. That is, the application of the second clock signal SCLKB of a reverse level of the level of the first clock signal SCLK is periodically repeated.

The entire reset signal ESR is applied as a low level voltage for a time t14 during which the light emitting signals Em[1] to Em[n] and the reverse light emitting signals EmB[1] to EmB[n] are simultaneously output, and is applied as a high level voltage during other period.

First, operation of the first light emitting driving block 510-1 will be described.

During a time t11, the frame start signal FLM is applied as the low level voltage. In this case, the first clock signal SCLK is applied as the low level voltage and the second clock signal SCLKB is applied as the high level voltage. The frame start signal FLM is input to the sequential input terminal IN of the first light emitting driving block 510-1. The first clock signal SCLK is input to the first clock signal input terminal CLK of the first light emitting driving block 510-1. The second clock signal SCLKB is input to the second clock signal input terminal CLKB of the first light emitting driving block 510-1. The fifth transistor M15, the tenth transistor M20, and the eleventh transistor M21 are turned on by the first clock signal SCLK. The frame start signal FLM of the low level voltage applied to the sequential input terminal IN is transmitted through the turn-on eleventh transistor M21. A voltage of the fourth node N14 becomes a low level voltage, and the ninth transistor M19 is turned on. The high-level second clock signal SCLKB applied to the second clock signal input terminal CLKB is transmitted through the turn-on ninth transistor M19. A voltage corresponding to a voltage difference of the fourth node N14 and the third node N13 is stored in the second capacitor C12. The voltage of the third node N13 becomes the high level voltage, and the fourth transistor M14, the sixth transistor M16, and the seventh transistor M17 are turned off by the third node N13. The first light emitting power source voltage VGH is transmitted to the third node N13 through the turn-on tenth transistor M20. The second light emitting power source voltage VGL is transmitted to the first node N11 through the turn-on fifth transistor M15. A voltage of the first node N11 becomes the low level voltage, and the first transistor M11 and the third transistor M13 are turned on. The second light emitting power source voltage VGL is transmitted to the light emitting signal output terminal EM through the turn-on first transistor M11, and the light emitting signal EM[1] of the low level voltage is output to the light emitting signal output terminal EM. The first light emitting power source voltage VGH is transmitted to the second node N12 through the turn-on third transistor M13, and the voltage of the second node N12 becomes the high level voltage. The second transistor M12 is turned off by the voltage of the second node N12, and the high level voltage is transmitted to the reverse light emitting signal output terminal EMB and the relay signal output terminal SR. The reverse light emitting signal EmB[1] of the high level voltage is output to the reverse light emitting signal output terminal EMB. The relay signal EM_SR[1] of the high level voltage is output to the relay signal output terminal SR.

During a time t12, the first clock signal SCLK is applied as the high level voltage and the second clock signal SCLKB is applied as the low level voltage. The fifth transistor M15, the tenth transistor M20, and the eleventh transistor M21 are turned off by the first clock signal SCLK. In this case, the ninth transistor M19 maintains the turn-on state by the voltage stored in the second capacitor C12. The second clock signal SCLKB of the low level voltage is transmitted to the third node N13 through the turn-on ninth transistor M19. The voltage of the third node N13 becomes the low level voltage, and the fourth transistor M14, the sixth transistor M16, and the seventh transistor M17 are turned on by the voltage of the third node N13. The first light emitting power source voltage VGH is transmitted to the first node N11 through the turn-on sixth and seventh transistors M16 and M17. The voltage of the first node N11 becomes the high level voltage, and the first and third transistors M11 and M13 are turned off by the voltage of the first node N1. A second low level voltage VGH_EMB is transmitted to the second node N12 through the turn-on fourth transistor M14. The voltage of the second node N12 becomes the low level voltage, and the second transistor M12 is turned on by the voltage of the second node N12. The first light emitting power source voltage VGH is transmitted to the light emitting signal output terminal EM through the turn-on second transistor M12. The light emitting signal Em[1] of the high level voltage is output to the light emitting signal output terminal EM. The reverse light emitting signal EMB[1] of the low level voltage is output to the reverse light emitting signal output terminal EMB by the voltage of the second node N12. The relay signal EM_SR[1] of the low level voltage is output to the relay signal output terminal SR by the voltage of the second node N12.

During a time t13*m* the frame start signal FLM is applied as the high level voltage, the first clock signal SCLK is applied as the low level voltage, and the second clock signal SCLKB is applied as the high level voltage. The fifth transistor M15, the tenth transistor M20, and the eleventh transistor M21 are turned on by the first clock signal SCLK. The frame start signal of the high level voltage applied to the sequential input terminal IN is transmitted to the fourth node M14 through the turn-on eleventh transistor M21. The voltage of the fourth node N14 becomes the high level, and the ninth transistor M19 is turned off by the voltage of the fourth node N14. The first light emitting power source voltage VGH is transmitted to the third node N13 through the turn-on tenth transistor M20. The voltage of the third node N13 becomes the high level voltage, and the fourth transistor M14, the sixth transistor M16, and the seventh transistor M17 are turned off by the voltage of the third node N13. The second light emitting power source voltage VGL is transmitted to the first node N11 through the turn-on fifth transistor M15. The voltage of the first node N11 becomes the low level voltage, and the first and third transistors M11 and M13 are turned on by the voltage of the first node N11. The second light emitting power source voltage VGL is transmitted to the light emitting signal output terminal EM through the turn-on first transistor M11, and the light emitting signal EM[1] of the low level voltage is output to the light emitting signal output terminal EM. The first light emitting power source voltage VGH is transmitted to the second node N12 through the turn-on third transistor M13, and the voltage of the second node M12 becomes the high level voltage. The second transistor M12 is turned off by the voltage of the second node N12, and the high level voltage is transmitted to the reverse light emitting signal output terminal EMB and the relay signal output terminal SR. The reverse light emitting signal EMB[1] of the high level voltage is output to the reverse light emitting signal output terminal EMB. The relay signal EM_SR[1] of the high level voltage is output to the relay signal output terminal SR.

In the second light emitting driving block 510-2, the relay signal EM_SR[1] of the first light emitting driving block 510-1 is input to the sequential input terminal IN, the second clock signal SCLKB is applied to the first clock signal input terminal CLK, and the first clock signal SCLK is input to the second clock signal input terminal CLKB. Thus, the second light emitting driving block 510-2 outputs the light emitting signal Em[2] of the high level voltage during the time t13 delayed by a duty of the clock signals SCLK and SCLKB than the time t12 at which the first light emitting driving block 510-1 outputs the light emitting signal Em[2] of the high level voltage. In addition, the second light emitting driving block 510-2 outputs the reverse light emitting signal EmB[2] and the relay signal EM_SR[2] during the time t13. That is, the second light emitting driving block 510-2 is driven after being delayed by a duty of the clock signals SCLK and SCLKB than the first light emitting driving block 510-1.

With such a method, the light emitting driving blocks 510-1, 510-2, 510-3, 510-4, . . . sequentially output the light emitting signals Em[1], Em[2], Em[3], Em[4], . . . , the reverse light emitting signals EmB[1], EmB[2], EmB[3], EmB[4], . . . , and the relay signals EM_SR[1], EM_SR[2], EM_SR[3], EM_SR[4], . . . .

During the time t14, the entire reset signal ESR is applied as the low level voltage. The entire reset signal ESR is simultaneously applied to the entire reset signal input terminals ER of the respective light emitting driving blocks 510-1, 510-2, 510-3, 510-4, . . . . When the entire reset signal ESR is applied as the low level voltage, the eighth transistor M18, the twelfth transistor M22, and the thirteenth transistor M23 are turned on. As the twelfth transistor M22 is turned on, the first light emitting power source voltage VGH is transmitted to the fourth node N14 and the voltage of the fourth node N14 becomes the high level voltage. The ninth transistor M19 is turned off by the voltage of the fourth node N14. As the eighth transistor M18 is turned on, the second light emitting power source voltage VGL is transmitted to the third node N13 and the voltage of the third node N13 becomes the low level voltage. The fourth transistor M14, the sixth transistor M16, and the seventh transistor M17 are turned on by the voltage of the third node N13. As the sixth transistor M16 and the seventh transistor M17 are turned on, the first light emitting power source voltage VGH is transmitted to the first node N11. The voltage of the first node N11 becomes the high level voltage, and the first and third transistors M11 and M13 are turned off by the voltage of the first node N11. As the fourth transistor M14 is turned on, the second low level power source voltage VGH_EMB is transmitted to the second node N12 and the voltage of the second node N12 becomes the low level voltage. The second transistor M12 is turned on by the voltage of the second node N12. The reverse light emitting signals EmB[1], EmB[2], EmB[3], EmB[4], . . . of the low level voltage are output to the reverse light emitting signal output terminal EMB by the voltage of the second node N12. As the thirteenth transistor M23 is turned on, the first light emitting power source voltage VGH is transmitted to the light emitting signal output terminal EM, and the light emitting signals Em[1], Em[2], Em[3], Em[4], . . . of the high level voltage are output to the light emitting signal output terminal EM.

Since the entire reset signal ESR is simultaneously applied to the light emitting driving blocks 510-1, 510-2, 510-3, 510-4, . . . , the light emitting driving blocks 510-1, 510-2, 510-3, 510-4, . . . simultaneously output the light emitting signals Em[1], Em[2], Em[3], Em[4], . . . of the high level voltage and the reverse light emitting signals EmB[1], EmB[2], EmB[3], EmB[4], . . . of the low level voltage for the time t14 during which the entire reset signal ESR is applied as the low level voltage. The time t14 corresponds to the entire reset period t4 of FIG. 3.

As described above, the third light emitting power source voltage VGL_EMB is provided in addition to the second light emitting power source VGL so that the reverse light emitting signal EmB[i] of the low level voltage can be stably output in the light emitting driving block 510. As the reverse light emitting signal EmB[i] of the low level voltage is stably output, the initialization period t1 and the threshold voltage compensation and data writing period t2 described with reference to FIG. 3 can be further stably performed. Thus, occurrence of the luminance deviation in the display device 10 due to voltage drop from the power source wiring can be further effectively prevented using the pixel 510.

While the above embodiments have been described in connection with the accompanying drawings, it is to be understood that the invention is not limited to the disclosed embodiments, but, on the contrary, is intended to cover various modifications and equivalent arrangements included within the spirit and scope of the appended claims. Therefore, those skilled in the art can understand to cover various modifications and equivalent embodiments. Accordingly, the true technical scope of the present should be defined by the technical spirit of the appended claims.

What is claimed is:

1. A light emission driver for a display device comprising:

a plurality of light emitting driving blocks, wherein each of the light emitting driving blocks is configured to receive first, second and third light emitting power source voltages and comprises:

a first node to which the second light emitting power source voltage is applied according to a first clock signal input to a first clock signal input terminal and the first light emitting power source voltage is applied according to a second clock signal input to a second clock signal input terminal;

a second node to which the first light emitting power source voltage is applied according to the first clock signal and the third light emitting power source voltage is applied according to the second clock signal, wherein the second node is electrically connected to a reverse light emitting signal output terminal;

a first transistor configured to be turned on by the first node and configured to transmit the second light emitting power source voltage to a light emitting signal output terminal;

a second transistor configured to be turned on by the second node and configured to transmit the first light emitting power source voltage to the light emitting signal output terminal;

a third transistor including a gate electrode electrically connected to the first node, a first electrode electrically connected to the first light emitting power source voltage, and a second electrode electrically connected to the second node;

a third node to which a third clock signal input to the second clock signal input terminal is applied according to a relay signal applied to a sequential input terminal from the previously arranged light emitting driving block and a fourth clock signal input to the first clock signal input terminal; and a fourth transistor including 1) a gate electrode electrically connected to the third node, 2) a first electrode electrically connected to the third light emitting power source voltage, and 3) a second electrode electrically connected to the second node, wherein the third light emitting power source voltage is different from the first and second light emitting power source voltages and is configured to drive reverse light emitting signals to be output to the reverse light emitting signal output terminal, and wherein the second node is electrically connected to a relay signal output terminal configured to output a relay signal applied to a sequential input terminal of the next light emitting driving block.

2. The light emission driver for the display device of claim 1, further comprising a fifth transistor including 1) a gate electrode electrically connected to the first clock signal input terminal, 2) a first electrode electrically connected to the second light emitting power source voltage, and 3) a second electrode electrically connected to the first node.

3. The light emission driver for the display device of claim 2, further comprising:

a sixth transistor including a gate electrode electrically connected to the third node and a first electrode electrically connected to the first light emitting power source voltage; and a seventh transistor including a gate electrode electrically connected to the third node, a first electrode electrically connected to a second electrode of the sixth transistor, and a second electrode electrically connected to the first node.

4. The light emission driver for the display device of claim 3, further comprising:

a fourth node to which a relay signal input to the sequential input terminal according to a fifth clock signal input to the first clock signal input terminal is transmitted; and a ninth transistor including a gate electrode electrically connected to the fourth node, a first electrode electrically connected to the second clock signal input terminal, and a second electrode electrically connected to the third node.

5. The light emission driver for the display device of claim 4, further comprising a tenth transistor including a gate electrode electrically connected to the first clock signal input terminal, a first electrode electrically connected to the first light emitting power source voltage, and a second electrode electrically connected to the third node.

6. The light emission driver for the display device of claim 5, further comprising an eleventh transistor including a gate electrode electrically connected to the first clock signal input terminal, a first electrode electrically connected to the sequential input terminal, and a second electrode electrically connected to the fourth node.

7. The light emission driver for the display device of claim 6, wherein the light emitting driving blocks are configured to substantially simultaneously output the first light emitting power source voltage to the light emitting signal output terminal according to an entire reset signal input to an entire reset signal input terminal, and substantially simultaneously output the third light emitting power source voltage to the reverse light emitting signal output terminal and the relay signal output terminal.

8. The light emission driver for the display device of claim 7, further comprising an eighth transistor including a gate electrode electrically connected to the entire reset signal input terminal, a first electrode electrically connected to the second light emitting power source voltage, and a second electrode electrically connected to the third node.

9. The light emission driver for the display device of claim 8, further comprising a twelfth transistor including a gate electrode electrically connected to the entire reset signal input terminal, a first electrode electrically connected to the first light emitting power source voltage, and a second electrode electrically connected to the fourth node.

10. The light emission driver for the display device of claim 9, further comprising a thirteenth transistor including a gate electrode electrically connected to the entire reset signal input terminal, a first electrode electrically connected to the first light emitting power source voltage, and a second electrode electrically connected to the light emitting signal output terminal.

11. The light emission driver for the display device of claim 10, wherein at least one of the first to thirteenth transistors is an oxide thin film transistor.

* * * * *